US005364235A

United States Patent [19]

Bearint

[11] Patent Number: 5,364,235

[45] Date of Patent: Nov. 15, 1994

[54] VARIABLE CAPACITY VANE COMPRESSOR WITH AXIAL PRESSURE DEVICE

[75] Inventor: David E. Bearint, Decatur, Ill.

[73] Assignee: Zexel USA Corporation, Decatur, Ill.

[21] Appl. No.: 126,927

[22] Filed: Sep. 27, 1993

[51] Int. Cl.[5] ..... F04C 18/344

[52] U.S. Cl. ..... 417/295

[58] Field of Search ..... 417/295, 310

[56] References Cited

U.S. PATENT DOCUMENTS

| | | | |
|---|---|---|---|
| 4,838,740 | 6/1989 | Watanabe et al. . | |
| 4,842,490 | 6/1989 | Watanabe et al. . | |
| 4,844,703 | 7/1989 | Watanabe et al. . | |
| 4,881,878 | 11/1989 | Kobayashi et al. . | |
| 5,020,975 | 6/1991 | Aihara . | |
| 5,030,066 | 7/1991 | Aihara et al. . | |
| 5,049,041 | 9/1991 | Nakajima | 417/295 |
| 5,129,791 | 7/1992 | Nakajima | 417/295 |
| 5,145,327 | 9/1992 | Nakajima et al. . | |

*Primary Examiner*—Richard E. Gluck
*Attorney, Agent, or Firm*—James E. Bradley

[57] ABSTRACT

A variable capacity vane compressor has an axial pressure device for applying variable axial pressure to a rotary valve. The rotary valve plate locates in a rotary valve housing and changes the capacity of the compressor due to its rotary position. An actuator member rotates the rotary valve plate in response to varying pressure in the discharge and intake chambers. A control valve supplies a variable control pressure to the actuating member for moving the actuating member to rotate the rotary valve plate. An annular axial pressure chamber is located between the rotary valve housing and the rotary valve plate. A control pressure port leads from the control valve to the axial pressure chamber. A seal member within the axial pressure chamber applies an axial force on a bearing located on the rotary valve plate. The control valve which supplies variable pressure used to vary the actuator member position also supplies the control pressure to the axial pressure chamber.

15 Claims, 4 Drawing Sheets

VARIABLE CAPACITY VANE COMPRESSOR WITH AXIAL PRESSURE DEVICE

BACKGROUND OF THE INVENTION

1. Field of the Invention

This invention relates in general to variable capacity vane compressors for air conditioning systems, particularly for vehicles, and in particular to an axial pressure device that enhances sealing between a rotary valve plate and a compression housing shoulder.

2. Description of the Prior Art

One type of automotive air conditioning compressor in use is a variable capacity vane compressor. In this type of compressor, a compression housing has a chamber that is oval in shape. A cylindrical rotor extends through the chamber. The rotor has radial vanes mounted to it which slide radially in slots formed in the rotor. Refrigerant at suction pressure enters the compression chamber, with the vanes compressing the refrigerant, which passes outward through a valve.

The compressor demand varies according to speed and atmosphere conditions. At highway speed, the demand is usually lower than while idling on a hot day. To vary the capacity, a rotary valve disk or plate mounts in front of the compression housing and in engagement with a shoulder on the compression housing. The valve plate has a slotted perimeter which will change the position of the opening from the intake chamber into the compression chamber depending upon the rotational position of the valve plate. The valve plate is rotatably carried in a rotary valve housing, also known as a rear side block. The particular rotational position of the valve plate will change the quantity of refrigerant introduced between the vanes for compression by changing the timing of the compression cycle.

An actuator will rotate the valve plate to selected positions depending upon the changes in the discharge pressure and the intake or suction pressure. In one type, such as shown in U.S. Pat. No. 5,145,327, the actuator member comprises radial projections mounted to the rear side of the rotary valve plate and located within chambers. Each projection serves as a piston. Variable fluid pressure is applied to both sides of each piston. Also, a spring will urge the plate to a minimum delivery position.

A control valve supplies a control pressure to one side of each piston, the other side of each piston being at intake pressure. The control valve includes a bellows which has a stem that engages a ball valve. The bellows is located in a portion of the suction chamber. A plunger or bias pin on the opposite side of the ball has one end exposed to discharge pressure. The plunger and the stem of the bellows cooperate depending upon the discharge and intake pressure to selectively apply a control pressure to one side of the pistons for moving the rotary valve plate.

In another type of actuator, the rotary valve plate is rotated by a spool piston, such as shown in U.S. Pat. No. 4,838,740. The spool piston moves linearly transverse to the axis of the rotor. The spool piston has a pivot pin that engages the plate to cause it to rotate as the spool piston moves. Patents exist which disclose a variety of control valves for applying pressure to the spool piston to cause it to move in response to intake and discharge pressure.

Whether the actuator is a linear piston or a radial projection, the rotary valve plate slidingly engages a shoulder facing rearward on the compression housing. The shoulder surrounds the compression chamber. The valve plate slidingly engages this shoulder as the valve plate rotates. Because the valve plate forms one end of the compression chamber, it is important to have as good a sealing as possible between the rotary valve plate and the compression shoulder. In the type of rotary valve plate wherein the actuating pistons are radially oriented projections mounted to the rear side and radially oriented, variable axial pressure is applied to the rotary valve plate because the rear side of the rotary valve plate is exposed to the chambers containing control pressure for rotating the valve plate. These chambers cause a forward acting axial force to assist in sealing between the face of the valve plate and the compression shoulder.

On the other hand, in the type utilizing a linearly movable spool piston, there is no axial pressure applied to the rear side of the rotary valve plate. Consequently, there would be a tendency for leakage to occur between the rotary valve plate and the compression shoulder. If installed very tightly, leakage could be minimized, however friction might make it difficult to rotate the rotary valve plate.

SUMMARY OF THE INVENTION

In this invention, the actuator is a spool piston type. It is located transverse to the axis of the rotor. A control valve supplies a control pressure to the actuator to cause it to move to rotate the valve plate. The rotary valve plate is located in a rotary valve housing, which also contains the chambers for the spool type actuator piston.

An annular axial pressure chamber is located between the rotary valve housing and the rotary valve plate. A control pressure port leads from the control valve to the axial pressure chamber to supply pressurized fluid to the axial pressure chamber. This pressurized fluid varies depending upon the demand on the compressor, and therefore provides a variable axial force on the rotary valve plate. This enhances sealing between the rotary valve face and the compression housing shoulder.

In the preferred embodiment, the axial pressure chamber is located in the rotary valve housing. An annular elastomeric seal locates in the axial pressure chamber. An annular bearing locates on the rotary valve plate in engagement with the seal. Control pressure supplied to the seal will cause the seal to exert an axial force on the bearing, which transmits to the rotary valve plate. The bearing allows rotation of the rotary valve plate while the seal remains stationary.

DETAILED DESCRIPTION OF THE INVENTION

Figure 1:
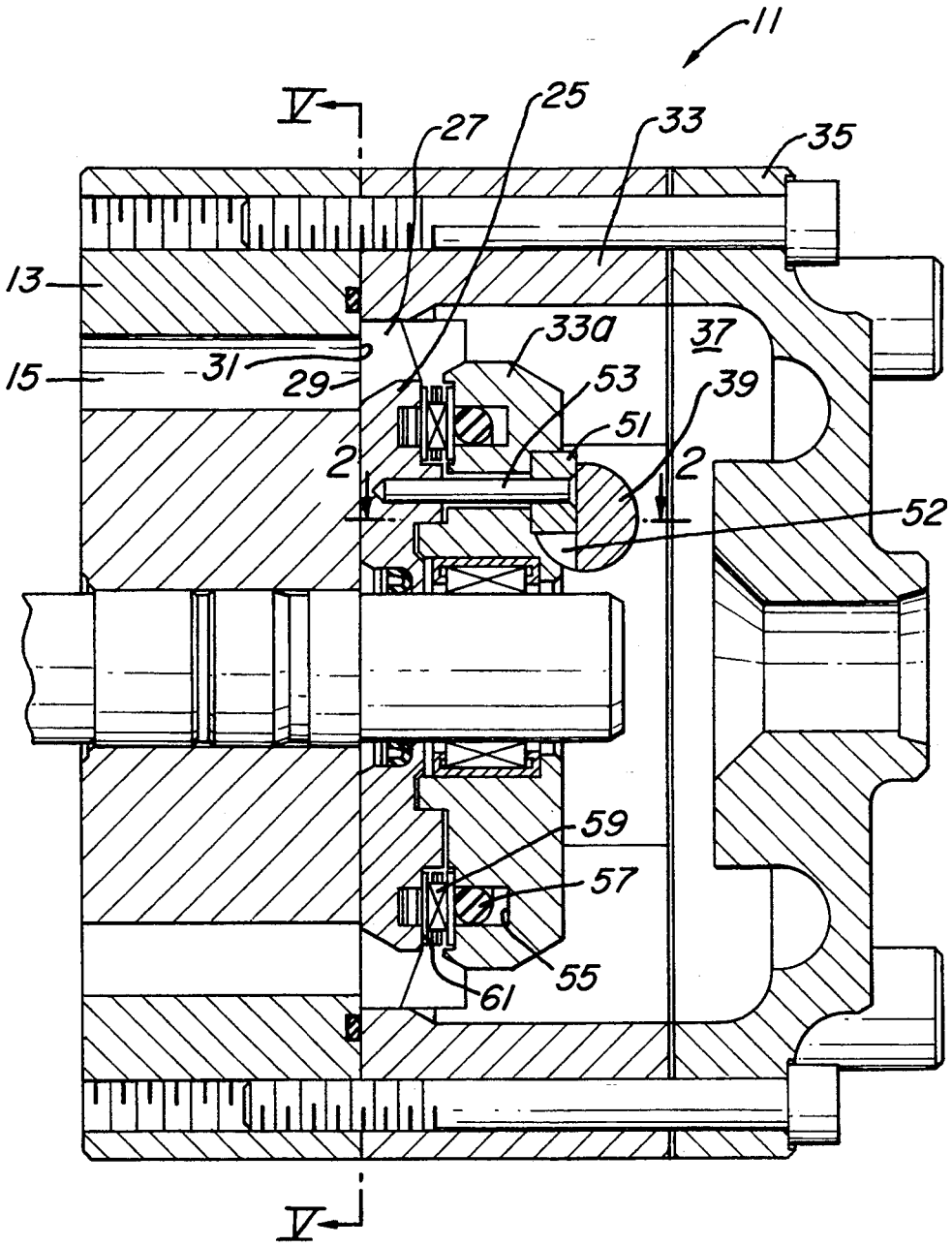
FIG. 1 is a partial sectional view illustrating a compressor constructed in accordance with this invention.
Figure 5:
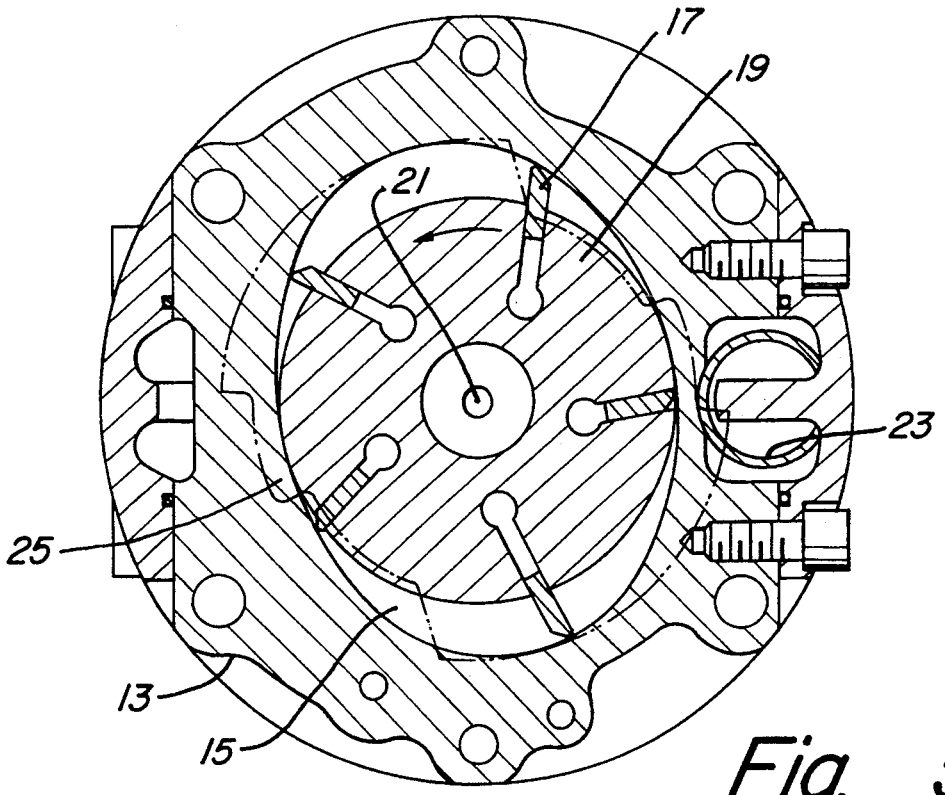
FIG. 5 is a sectional view of the compressor of FIG. 1, taken along the line V—V of FIG. 1.

Referring to FIG. 1, compressor 11 is shown partly in a sectional view. Compressor 11 is a variable capacity vane type Compressor. It includes a compressor housing 13 which has compression chamber 15. As shown in FIG. 5, compression chamber 15 is generally oval in configuration. A plurality of vanes 17 mounted in slots on a rotor 19 rotate inside compression chamber 15. Rotor 19 rotates on an axis 21 that is concentric with compression chamber 15. Valves 23 (only one shown) provide for the discharge of refrigerant gas from the compression chamber 15. The refrigerant gas passes to a discharge chamber 16 and is the type as shown in U.S. Pat. No. 5,145,327, Nakajima, et al, Sep. 8, 1992, all of which material is hereby incorporated by reference.

Figure 6:
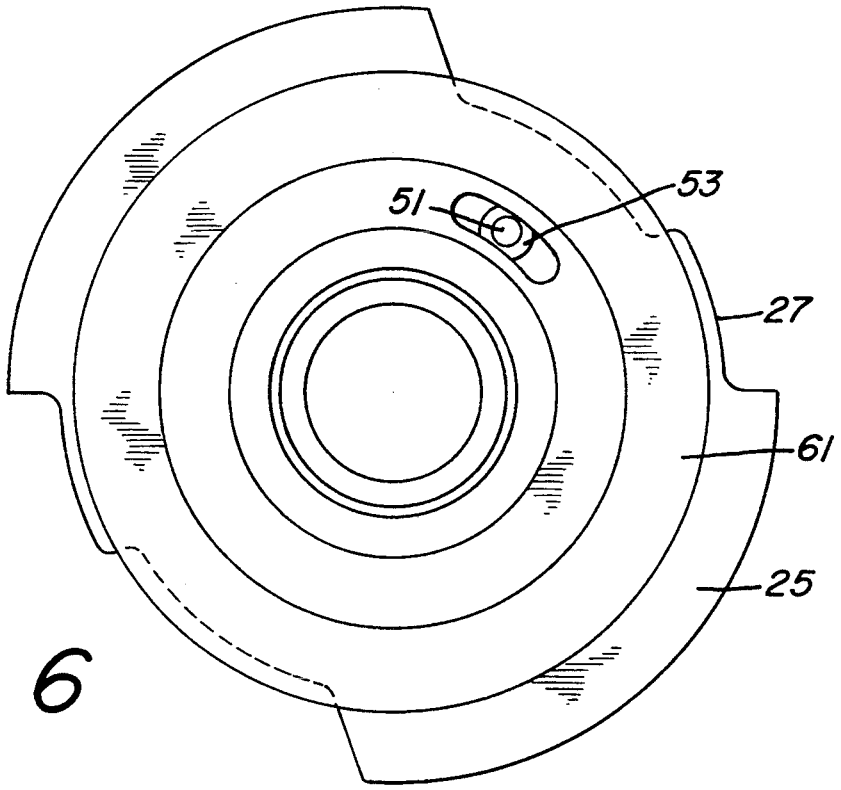
FIG. 6 is a rear elevational view of the rotary valve plate used with the compressor of FIG. 1.

Referring again to FIG. 1, a rotary valve plate 25 mounts rotationally to the intake side of compressor chamber 15. Rotary valve plate 25 is a disk-shaped member, having an irregular perimeter 27 as shown in FIG. 6, which defines slots. As shown in FIG. 5, the particular rotational position of rotary valve plate 25 will change the position of the intake opening into the compression chamber 15 and thus the volume of refrigerant introduced between the vanes 17 as rotor 19 rotates. In this manner, the capacity of compressor 11 can be varied.

Referring again to FIG. 1, rotary valve plate 25 has a face 29 on the forward side that slidingly engages a compression housing shoulder 31. The compression housing shoulder 31 surrounds compression chamber 15. The contact is metal-to-metal between rotary valve face 29 and compression housing shoulder 31.

Rotary valve plate 25 will rotate approximately 70 degrees from a fully closed position to a fully open position. Rotary valve plate 25 is carried in a rotary valve housing 33, also called a rear side block. Rotary valve housing 33 mounts stationarily to compression housing 13 and has a central portion 33*a*. A rear head 35 mounts to the rear of rotary valve housing 33 by bolts. An intake chamber 37 is defined within rear head 35 and surrounds the central portion 33*a* of rotary valve housing 33. Intake chamber 37 will be at the suction or intake pressure of the refrigerant after it has passed through the evaporator (not shown).

Figure 2:
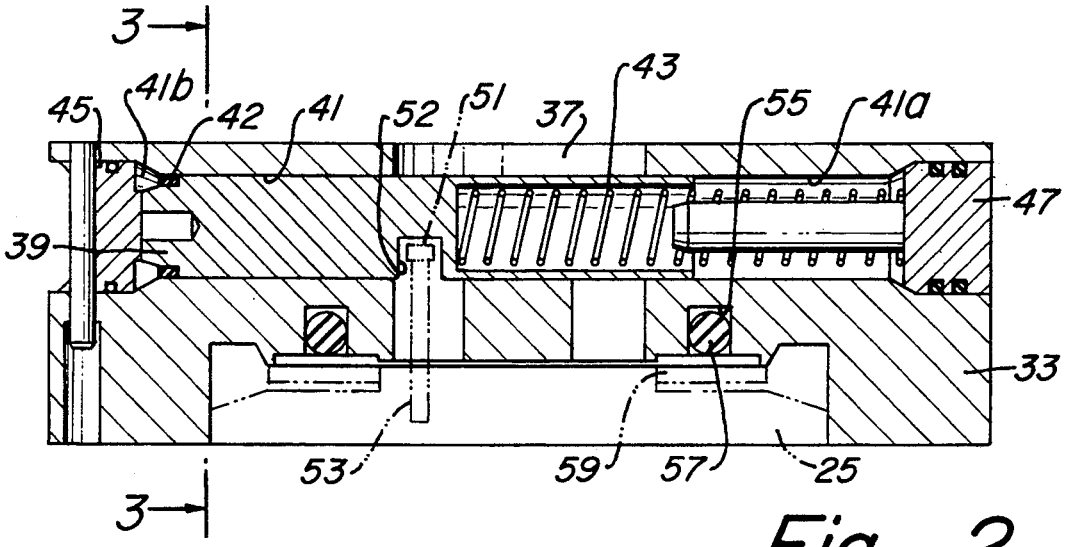
FIG. 2 is another sectional view of the compressor of FIG. 1, taken along a section line 2—2 of FIG. 1.

An actuator member or piston 39 will rotate rotary valve housing 33 between the minimum and maximum positions. Actuator piston 39 is a spool-type piston, located transverse to the axis 21 of rotor 19. As shown in FIG. 2, actuator piston 39 is located in a piston chamber 41 which extends transversely through rotary valve housing 33. The central portion of piston chamber 41 is intersected by a portion of intake chamber 37, thus resulting in two separate sections. Actuator piston 39 has a seal 42 which defines in chamber 41 a suction side 41*a*, which is on the right side of seal 42, and a control pressure side 41*b*, which is on the left side of seal 42. Control pressure side 41*b* is supplied with a control pressure for moving actuator piston 39 to the right in response to change in demand on compressor 11. A coil spring 43 urges actuator piston 39 to the left, which positions rotary valve plate 25 in the minimum capacity position. End caps 45, 47 seal the opposite ends of piston chamber 41. A suction passage (not shown) extends from the intake chamber 37 to the suction side 41*a* to assure that suction pressure is communicated to the suction side 41*a* of piston chamber 41.

Figure 3:
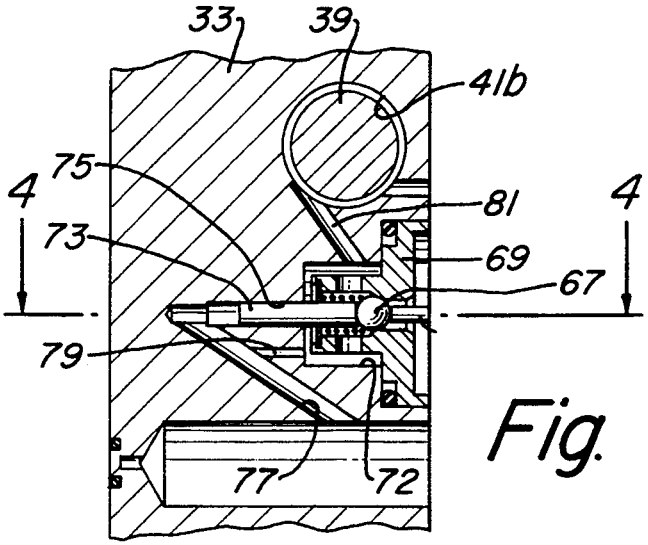
FIG. 3 is a partial sectional view of the compressor of FIG. 1, taken along another section line 3—3 of FIG. 2.

Referring to FIGS. 1 and 3, the linkage means between actuator piston 39 and rotary valve plate 25 includes in the preferred embodiment a roller 51, which is a small, slidable member locating within an undercut 52 in actuator piston 39. Roller 51 is rotatably supported on a pin boss 53, which is rigidly mounted to rotary valve plate 25. Linear movement of actuator piston 39 causes rotational movement of rotary valve plate 25 through roller 51 and pin boss 53.

Referring again to FIG. 1, axial piston means exist for applying a variable axial force on rotary valve plate 25 to enhance sealing between rotary valve face 29 and compression housing shoulder 31. The axial piston means includes an annular axial pressure chamber 55 that is located in central portion 33*a* of rotary valve housing 33. Axial pressure chamber 55 is a groove concentric to rotor axis 21. Axial pressure chamber 55 is rectangular in transverse cross section. Control pressure will be supplied to axial pressure chamber 55, as will be explained subsequently.

The axial piston means also includes a seal member or seal ring 57, which is sealingly located in axial pressure chamber 55. Seal ring 57 is a conventional O-ring, circular in transverse cross section. Seal ring 57 will have its rearward side exposed to control pressure in axial pressure chamber 55. An annular bearing 59 is located on a shoulder 61 on rotary valve plate 25. Bearing 59 is a conventional thrust bearing which has one side engaged by seal ring 57 and the other side in contact with shoulder 61. In the preferred embodiment, bearing 59 is a needle-type thrust bearing, with needles located between forward and rearward plates. The forward plate, which is in contact with shoulder 61, will rotate with rotary valve plate 25, while the rearward plate of bearing 59 will remain in stationary engagement with seal ring 57. Seal ring 57 can move axially within axial pressure chamber 55 to exert a variable axial force on bearing 59 to increase and decrease the force of rotary valve face 29 on compression housing shoulder 31.

Figure 4:
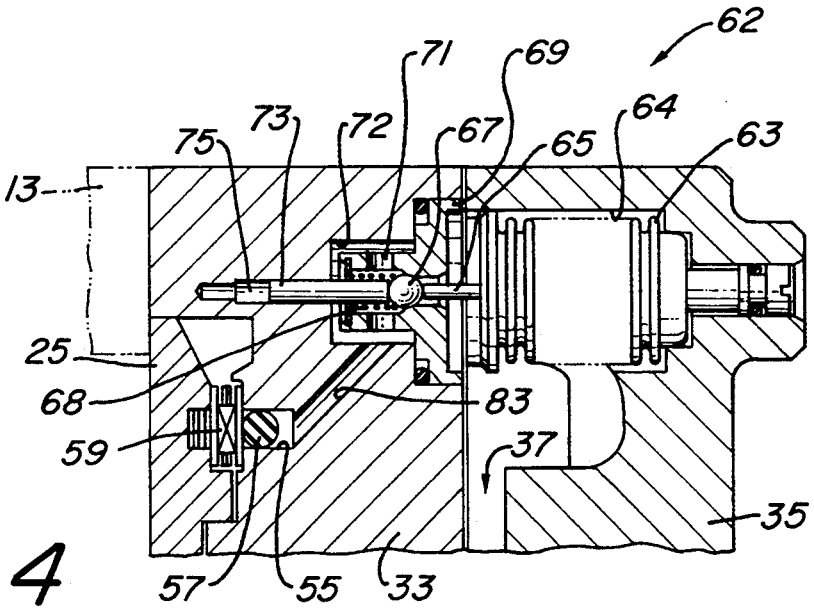
FIG. 4 is another partial sectional view of the compressor of FIG. 1, taken section line 4—4 of FIG. 3 and with a portion of the rear head shown in section.

A control valve 62 for supplying control pressure to actuator piston 39 and to axial pressure chamber 55 is shown in FIG. 4, and partially in FIG. 3. Control valve 62 does not appear in FIG. 1 because of the different sectional view shown in FIG. 1. Control valve 62 appears only partially in FIG. 3, because the rear head 35 is not shown in FIG. 3. Control valve 62 includes a bellows 63 which is initially evacuated and mounts within a cavity 64 in the rear head 35. Cavity 64 is in communication with intake chamber 37, thus the exterior of bellows 63 is in communication with intake chamber 37. Bellows 63 has a stem 65 that extends parallel to the rotor axis 21 (FIG. 1). Stem 65 will move forward and rearward due to expansion and contraction of bellows 63.

Stem 65 engages a ball 67 which is located in a ball seat member 69 and urged by a spring 68 to a closed position. Ball seat member 69 is located in rotary valve housing 33. Lateral holes 71 extend outward from ball seat member 69 to allow the discharge of fluid into control chamber 72 in rotary valve housing 33. A bias pin or plunger 73 slidably moves within a plunger passage 75. Bias pin 73 is coaxial with stem 65 and engages the opposite side of ball 67. If bellows 63 expands, stem 65 pushes ball 67 to the left off the seat of seat member 69, and pushing bias pin 73 to the left. Ball 67 then is in an open position to allow flow of fluid from control chamber 72, through lateral holes 71, and into the suction chamber 37. Conversely, if bellows 63 contracts, spring 68 pushes ball 67 back into the seat of seat member 69, blocking communication between suction chamber 37 and control chamber 72.

Figure 7:
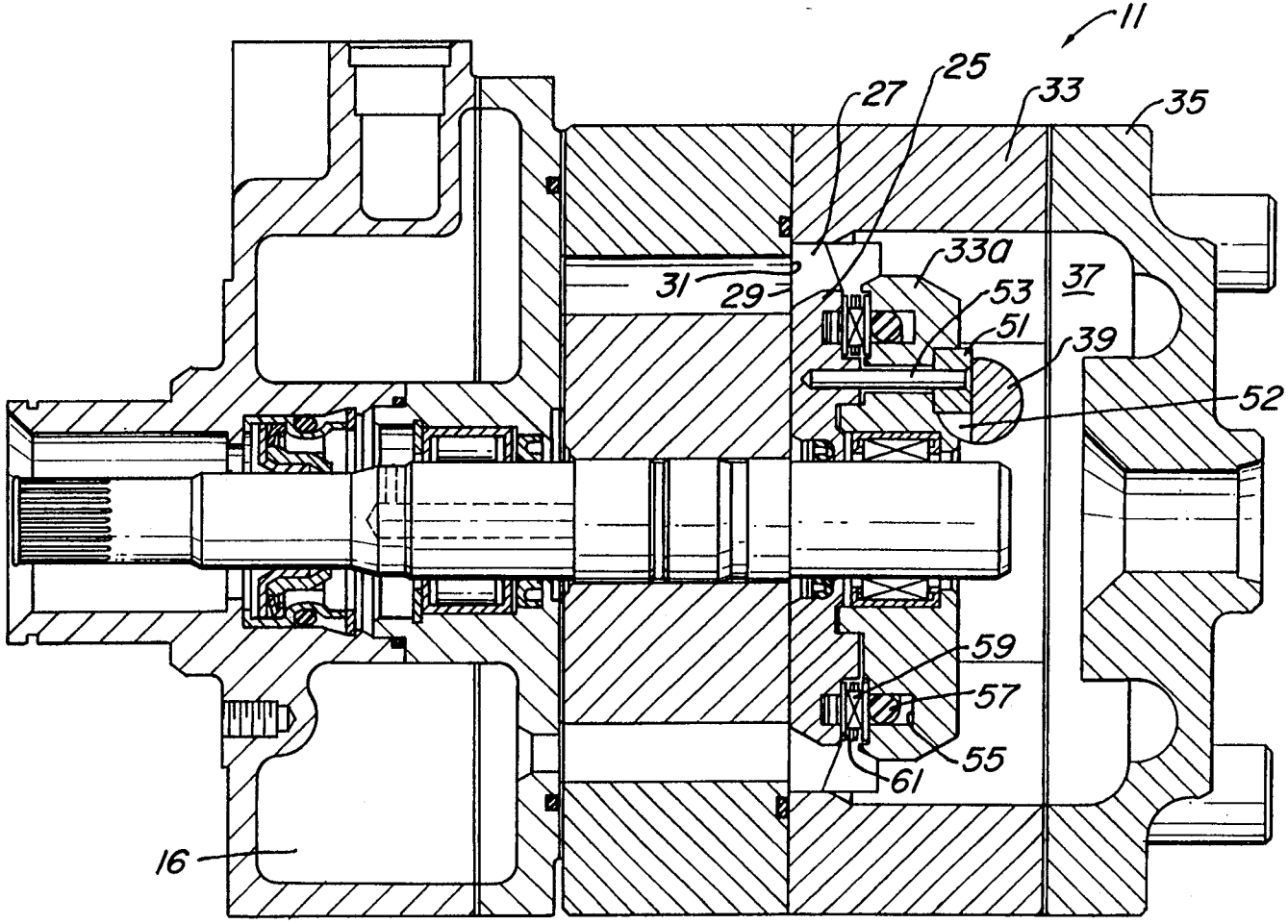
FIG. 7 is a sectional view of the compressor similar to FIG. 1, but showing the discharge chamber.

As shown in FIGS. 3 and 7, discharge pressure from the discharge chamber 16 of compressor 11, is applied through a passage 77 to the base of plunger passage 75. The pressure thus acts on the left end of bias pin 73, urging bias pin 73 toward ball 67. A metered orifice 79 extends from passage 77 to control chamber 72. Metered orifice 79 is a small diameter drilled hole to allow a continuous selected flow rate of discharge pressure refrigerant to pass into control chamber 72. A control pressure passage 81 leads to control pressure side 41*b* of piston chamber 41. Passages 77, 79 and 81 do not appear in FIG. 4 because of the different sectional view. Also, bellows 63 is not shown in FIG. 3 for simplicity.

Referring again to FIG. 4, a control pressure port 83 leads from control pressure chamber 72 to the axial pressure chamber 55. Control pressure port 83 provides a supply of refrigerant at the control pressure in control chamber 72 to the seal ring 57. Pressure port 83 thus serves as part of a passage means for supplying a variable control pressure to seal ring 57.

At startup, the actuator piston 39 will be located in the position shown in FIG. 2. Rotary valve plate 25 will be in the minimum delivery position. Referring to FIGS. 3 and 4, initially the bellows 63 will be contracted and the force of discharge pressure on the end of bias pin 73 plus the force of spring 68 on ball 67 will keep ball 67 closed. Discharge pressure from passage 77 is applied to bias pin 73 and also flows through metered orifice 79 into control chamber 72, and through control pressure passage 81 to the control pressure side 41*b* of actuator piston chamber 41. This causes piston 41 to move to the right from the position shown in FIG. 2, rotating rotary valve plate 25. This increases the capacity of compressor 11 by changing the timing of the compression cycle and increasing the volume of refrigerant being compressed.

At the same time, discharge pressure is applied through control pressure port 83 to seal ring 57, which applies an axial force to rotary valve plate 25. This causes rotary valve plate 25 to more tightly bear against compression housing shoulder 31. Consequently, at high pressures within compression chamber 15, a high axial force proportional to the discharge pressure is applied against the rotary valve plate 25 to enhance sealing with compression housing shoulder 31.

At highway speeds and at cooler conditions, the demand will decrease on compressor 11. The discharge pressure and the suction pressure in suction chamber 37 will decrease. The lower suction pressure causes bellows 63 to expand. When the force due to the expansion of bellows 63 exceeds the force due to spring 68 plus the force due to discharge pressure acting on bias pin 73, stem 65 will push ball 67 off of its seat. This exposes control chamber 72 to pressure in suction chamber 37. Some of the pressure can then bleed through passage 81 (FIG. 3), control chamber 72, lateral holes 71 into the suction chamber 37. This decreases the force on actuator piston 39, causing it to move to the left to rotate valve plate 25, reducing the capacity of compressor 11.

At the same time, the lower pressure in control chamber 72 is applied through control pressure port 83 to the axial pressure chamber 55. The reduced pressure on seal ring 57 reduces the axial force on rotary valve plate 25. This allows rotary valve plate 25 to more freely rotate back to a lesser capacity position. Consequently, the axial force in rotary valve plate 25 varies in proportion to the control pressure applied to actuator piston 39.

This invention has significant advantages. Applying an axial force to the rotary valve plate enhances sealing between the rotary valve face and the compression housing shoulder. Varying the force in response to demand of the compressor avoids applying too much force when the valve needs to rotate to a new position.

While the invention has been shown in only one of its forms, it should be apparent to those skilled in the art that it is not so limited, but is susceptible to various changes without departing from the scope of the invention.

I claim:

1. In a compressor having a compression housing defining a compression chamber with an axis, a rotatably driven rotor having a plurality of radial vanes and extending axially through the compression chamber, an intake chamber on one end of the compression chamber and a discharge chamber on the other end of the compression chamber, the compression housing having a compression housing shoulder that is substantially perpendicular to the axis and facing the intake chamber, a rotary valve housing mounted to the compression housing in the intake chamber, a rotary valve plate rotatably carried in the valve housing and having a rotary valve face in sliding contact with the compression housing shoulder and configured to vary the position of an opening from the intake chamber to the compression chamber, an actuator member for rotating the rotary valve plate, and a control valve for supplying a variable control pressure to the actuator member for moving the actuator member and rotary valve plate in response to varying pressures in the intake chamber and discharge chamber, the improvement comprising:

an annular axial pressure chamber located rotary valve housing and the rotary valve plate; and a control pressure port leading from the control valve to the axial pressure chamber to supply pressurized fluid to the axial pressure chamber to provide a variable axial force on the rotary valve plate to enhance sealing between the rotary valve face and the compression housing shoulder; and wherein at least a portion of the axial pressure chamber is located within the rotary valve housing.

2. The compressor according to claim 1, wherein the axial pressure chamber is located within the rotary valve housing, and wherein the compressor further comprises:

an annular seal member sealingly located within the axial pressure chamber, the seal member applying an axial force to the rotary valve plate in response to the pressurized fluid from the control pressure port.

3. The compressor according to claim 1, wherein the axial pressure chamber is located within the rotary valve housing, and wherein the compressor further comprises:

an annular elastomeric seal member sealingly located within the axial pressure chamber, the seal member moving axially in response to the pressurized fluid from the control pressure port for applying an axial force to the rotary valve plate.

4. The compressor according to claim 1, wherein the axial pressure chamber is located within the rotary valve housing, and wherein the compressor further comprises:

an annular bearing on the rotary valve plate; and an annular seal member sealingly located within the axial pressure chamber, the seal member engaging the bearing and in response to the pressurized fluid from the control pressure port, applying an axial force to the bearing on the rotary valve plate.

5. The compressor according to claim 1, wherein the axial pressure chamber is located within the rotary valve housing, and wherein the compressor further comprises:

an annular bearing on the rotary valve plate; and an annular elastomeric seal member sealingly located within the axial pressure chamber, the seal member engaging the bearing and moving axially in the axial pressure chamber in response to the pressurized fluid from the control pressure port for applying an axial force to the bearing on the rotary valve plate.

6. In a compressor having a compression housing defining a compression chamber with an axis, a rotatably driven rotor having a plurality of radial vanes and extending axially through the compression chamber, an intake chamber on one end of the compression chamber and a discharge chamber on the other end of the compression chamber, the compression housing having a compression housing shoulder that is substantially perpendicular to the axis and facing the intake chamber, a rotary valve housing mounted to the compression housing in the intake chamber, a rotary valve plate rotatably carried in the valve housing and having a rotary valve face in sliding contact with the compression housing shoulder and configured to vary the position of an opening from the intake chamber to the compression chamber, the improvement comprising:

a linearly movable actuator member engaging the rotary valve plate by a pivot pin for rotating the rotary valve plate;

a control valve for supplying a variable control pressure to the actuator member for moving the actuator member and rotary valve plate in response to varying pressures in the intake chamber and discharge chamber;

an annular axial pressure chamber located between the rotary valve housing and the rotary valve plate; and a control pressure port leading from the control valve to the axial pressure chamber to supply pressurized fluid to the axial pressure chamber to provide a variable axial force on the rotary valve plate to enhance sealing between the rotary valve face and the compression housing shoulder.

7. The compressor according to claim 1, wherein the pressurized fluid supplied through the control pressure port is substantially the same as the control pressure supplied to the actuating member.

8. In a compressor having a compression housing defining a compression chamber with an axis, a rotatably driven rotor having a plurality of radial vanes and extending axially through the compression chamber, an intake chamber on one end of the compression chamber and a discharge chamber on the other end of the compression chamber, the compression housing having a compression housing shoulder that is substantially perpendicular to the axis and facing the intake chamber, a rotary valve housing mounted to the compression housing in the intake chamber, a rotary valve plate rotatably carried in the valve housing and having a rotary valve face in sliding contact with the compression housing shoulder, the rotary valve plate being configured to vary the position of an opening from the intake chamber to the compression chamber, a linearly movable actuator member engaging the rotary valve plate by a pivot point for rotating the rotary valve plate, and control valve means for supplying pressurized refrigerant at a variable control pressure to the actuator member for moving the actuator member and rotary valve plate in response to varying pressures of refrigerant in the intake chamber and discharge chamber, the improvement comprising:

axially movable piston means for applying an axial force to the rotary valve plate to urge the rotary valve face against the compression shoulder; and control pressure passage means for supplying a pressurized fluid from the control valve means to the axially movable piston means in response to varying pressure of refrigerant in the intake chamber and discharge chamber.

9. The compressor according to claim 8 wherein the axially movable piston means is mounted to the valve housing, and wherein the control pressure passage means comprises a control pressure port extending from the control valve means to the axially movable piston means.

10. The compressor according to claim 8 wherein:

the valve housing is provided within an annular axial pressure chamber located adjacent the rotary valve plate;

the axially movable piston means is mounted in the axial pressure chamber; and the control pressure passage means comprises a control pressure port extending from the control valve means to the axial pressure chamber.

11. The compressor according to claim 8 wherein:

the valve housing has an annular axial pressure chamber located adjacent the rotary valve plate;

the axially movable piston means comprises an annular seal member mounted in the axial pressure chamber; and the control pressure passage means comprises a control pressure port extending from the control valve means to the axial pressure chamber for moving the seal member axially in response to pressurized refrigerant supplied from the control valve means.

12. The compressor according to claim 8 wherein:

the valve housing has an annular axial pressure chamber located adjacent the rotary valve plate;

the axially movable piston means comprises an annular seal member mounted in the axial pressure chamber and bearing means mounted to the rotary valve plate for allowing rotation of the rotary valve plate relative to the seal member; and the control pressure passage means comprises a control pressure port extending from the control valve means to the axial pressure chamber for moving the seal member axially in response to pressurized refrigerant supplied from the control valve means into engagement with the bearing means.

13. In a compressor having a compression housing defining a compression chamber with an axis, a rotatably driven rotor having a plurality of radial vanes and extending axially through the compression chamber, an intake chamber on one end of the compression chamber and a discharge chamber on the other end of the compression chamber, the compression housing having a compression housing shoulder that is substantially perpendicular to the axis and facing the intake chamber, a rotary valve housing mounted to the compression housing in the intake chamber, a rotary valve plate rotatably carried in the valve housing and having a rotary valve face in sliding contact with the compression housing shoulder and configured to vary the position of an opening from the intake chamber to the compression chamber, a linearly movable actuator member engaging the rotary valve plate by a pivot pin for rotating the rotary valve plate, and control valve means for supplying pressurized refrigerant at a variable control pressure to the actuator member for moving the actuator member and rotary valve plate in response to varying pressures of refrigerant in the intake chamber and discharge chamber, the improvement comprising:

an annular axial pressure chamber located in the valve housing adjacent the rotary valve member;

an annular seal member mounted sealingly in the axial pressure chamber;

a bearing mounted to the rotary valve plate adjacent the seal member; and a control pressure port extending from the control valve means to the axial pressure chamber for moving the seal member axially in the axial pressure chamber in response to pressurized refrigerant supplied from the control valve means into engagement with the bearing to apply a variable axial force to the rotary valve plate to enhance sealing between the rotary valve face and the compression housing shoulder.

14. The compressor according to claim 12 wherein the refrigerant supplied from the control valve means to the axial pressure chamber is at substantially the same pressure as the pressurized refrigerant supplied to the actuator member.

15. The compressor according to claim 12 wherein the seal member is circular in transverse cross-section.

* * * * *